US005577158A

United States Patent [19]

Källgren et al.

[11] Patent Number: 5,577,158

[45] Date of Patent: Nov. 19, 1996

[54] CAPACITIVE LEAKAGE CURRENT CANCELLATION FOR HEATING PANEL

[75] Inventors: Johan Källgren, Columbus; Donald A. Coates, W. Worthington; Sanjay Shukla, Westerville; Steven M. Dishop, Huntsville, all of Ohio

[73] Assignee: White Consolidated Industries, Inc., Cleveland, Ohio

[21] Appl. No.: 503,039

[22] Filed: Jul. 17, 1995

[51] Int. Cl.[6] ..... H05B 3/00

[52] U.S. Cl. ..... 392/433; 219/509; 219/543; 219/395; 338/325; 338/308; 338/295; 361/47

[58] Field of Search ..... 392/432–439; 219/509, 543, 395, 544; 338/325, 308, 309, 295; 361/42, 47, 48

[56] References Cited

U.S. PATENT DOCUMENTS

| | | | |
|---|---|---|---|
| Re. 33,529 | 1/1991 | Cremer et al. | 219/543 |
| 2,678,990 | 8/1951 | Quirk . | |
| 3,412,234 | 11/1968 | Otavka . | |
| 3,465,121 | 9/1969 | Clark | 392/435 |
| 3,465,125 | 9/1969 | McArthur, Jr. . | |
| 3,800,121 | 3/1974 | Dean et al. | 219/543 |
| 4,055,745 | 10/1977 | Balaguer . | |
| 4,136,733 | 1/1979 | Asselman et al. . | |
| 4,163,139 | 7/1979 | Malarkey et al. . | |
| 4,298,789 | 11/1981 | Eichelberger et al. . | |
| 4,370,692 | 1/1983 | Wellman, Jr. et al. | 361/46 |
| 4,616,125 | 10/1986 | Oppitz | 219/553 |
| 4,889,974 | 12/1989 | Auding et al. . | |
| 5,164,161 | 11/1992 | Feathers et al. . | |
| 5,221,829 | 6/1993 | Yahav et al. . | |
| 5,304,784 | 4/1994 | Tagashira et al. | 219/543 |
| 5,440,667 | 8/1995 | Simpson et al. | 361/42 |

FOREIGN PATENT DOCUMENTS

| | | | |
|---|---|---|---|
| 2307640 | 8/1974 | Germany | 392/435 |
| 55-139020 | 1/1980 | Japan . | |
| 7709190 | 3/1979 | Sweden . | |

*Primary Examiner*—John A. Jeffery

*Attorney, Agent, or Firm*—Pearne, Gordon, McCoy & Granger

[57] ABSTRACT

A heating panel has a metal substrate, ceramic inner and outer insulating layers on the substrate. A film of resistive material forms a heating layer on one of the insulating layers. The heating layer has electrodes on opposite edges connected to different phases of a multiphase power source. Another electrode is connected to a neutral of the power source. Capacitive currents caused in the substrate by the different phases cancel each other. Thus, leakage current is minimized through a conductor connected between the substrate and ground. The heating panel can be adapted for two phase or three phase systems. The heating panels are particularly useful for defining a heating cavity of an oven.

32 Claims, 4 Drawing Sheets

CAPACITIVE LEAKAGE CURRENT CANCELLATION FOR HEATING PANEL

BACKGROUND OF THE INVENTION

1. Field of the Invention

This invention relates generally to the field of heating and specifically to minimizing leakage currents in a heating panel.

2. Description of the Related Art

Ovens are commonly heated by one or more of several means, including burning combustible gases and electrical resistance. One form of electrical resistance heating uses monolithic integrated heat sources, known as "heat panels," disposed on walls of the oven. Heat panels include a thermally and electrically conductive metal substrate or core covered by a thermally conductive and electrically insulative material on opposed faces. One face of the insulative material has a heating layer or film of electrically resistive material disposed thereon and connected to a current to generate heat. The heat is conducted through the other layers to the oven cavity. An example of such an apparatus is shown in U.S. Pat. No. 4,298,789 to Eichelberger, incorporated herein by reference.

Industry standards require the substrate to be connected to ground. The electrically conductive layers separated by an insulating layer form a capacitor. Thus, when an alternating current (AC) passes through the heating layer, a capacitive AC leakage current caused in the substrate and a resistive leakage current through the insulator become leakage current to ground when the substrate is connected to ground. The leakage current to ground will usually exceed industry standards or codes. Thus, the need exists for a heating panel type oven that will meet industry standards.

In addition, if the substrate is connected to neutral or ground of a power source, the leakage current should also be minimized. If the substrate is floating, the electrical potential that builds up on it must be as low as possible.

SUMMARY OF THE INVENTION

The present invention provides a heating panel including a heating layer of electrically resistive sheet material; a substrate of electrically conductive sheet material; and an insulating layer disposed between the heating layer and the substrate. First and second electrodes are attached to the heating layer and adapted for being electrically connected to different phases of a multiphase power source such as a synthetic 240 V household powersource, commonly known as the Edison System. A third electrode is attached to the heating layer and adapted for being electrically connected to a neutral of the power source. The heating layer is adapted for converting electrical current therethrough to heat energy transferred therefrom. The substrate is adapted for being connected to ground.

The insulating layer is thermally conductive. A second insulating layer is disposed on a face of the substrate opposite the first insulating layer. The first and second insulating layers can be joined so as to substantially enclose the substrate. The first and second electrodes are disposed along opposite edges of the heating layer, and the third electrode is disposed between the first and second on a face of the heating layer. The electrodes are elongated bars having substantially identical lengths. The heating layer is typically graphite, tin dioxide, or resistive thick film, the substrate is steel or aluminum, and the insulating layer is ceramic or organic polymers.

If the power source has two phases, the first and second electrodes are adapted for being connected 180° out of phase. A fourth electrode can be electrically connected to the heating layer and adapted for being connected to a third phase of the power source. If the power source has three phases, the first, second, and fourth electrodes are adapted for being connected 120° out of phase from each other. A fifth electrode can be electrically connected to the heating layer and adapted for being connected to the neutral. The third electrode is disposed between the first and second electrodes and the fifth electrode is disposed between the second and fourth electrodes. The first and fourth electrodes are disposed along opposite edges of the heating layer and the second electrode is disposed about midway between the first and fourth electrodes.

The invention also provides a heating panel assembly including first and second heating panels. The first electrodes are respectively adapted for being electrically connected to different phases of a multiphase power source, and the second electrodes are adapted for being electrically connected to a neutral of the power source. The heating panels are arranged to define a heating cavity. A third heating panel has a first electrode adapted for being electrically connected to a phase of the multiphase power source different from the phases to which the first electrodes of the first and second panels are adapted for being connected. The second electrode of the third panel being adapted for being electrically connected to the neutral of the power source.

In another construction of the heating panel, first and second heating layers of electrically resistive sheet material are disposed on opposite faces of the substrate. A first insulating layer is disposed between the first heating layer and the substrate, and a second insulating layer is disposed between the second heating layer and the substrate. First and second electrodes are attached to each heating layer. The first electrodes on each heating layer are respectively adapted for being electrically connected to different phases of a multiphase power source. The second electrodes on each heating layer are adapted for being electrically connected to a neutral of the power source. A third heating layer of electrically resistive sheet material is disposed adjacent the first heating layer on a face of the substrate. The first insulating layer is disposed between the third heating layer and the substrate. The first electrode of the third heating layer being adapted for being electrically connected to a phase of the multiphase power source different from the phases to which the first electrodes of the first and second heating layers are adapted for being connected. The second electrode of the third heating layer being adapted for being electrically connected to the neutral of the power source.

The invention also provides an oven including an enclosure defining a generally parallelepipedic cooking cavity having five walls closed by a door. A heating panel is disposed on each of the five walls and the door.

DESCRIPTION OF THE PREFERRED EMBODIMENTS

Figure 1:
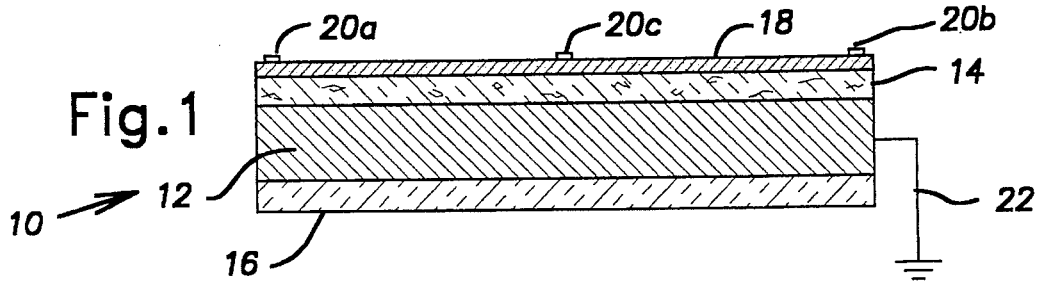
FIG. 1 shows a schematic end view of a heating panel for a two phase system according to the invention.
Figure 6:
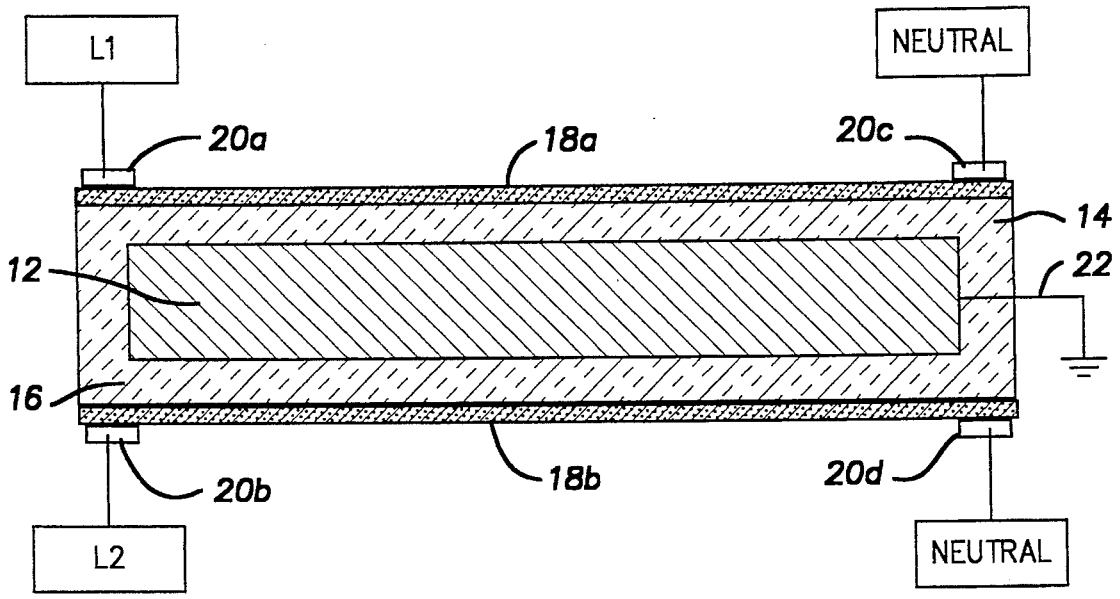
FIG. 6 shows an end view of a heating panel for a two phase system according to another embodiment of the invention.

Referring to FIG. 1, a heating panel 10 includes a substrate 12 made of a thermally and electrically conductive, durable material, such as steel. The substrate is preferably formed as a rectangular sheet generally defining dimensions of the panel 10. "Panel" refers generally to flat sheets or other shapes, such as cylinders or bent sheets. An outer insulating layer 14 of electrically insulating material, such as a ceramic, is applied to at least one face or surface of the substrate 12 so that an interior surface of the outer insulating layer 14 is in thermal communication with the substrate 12. Other suitable insulating materials include porcelain enamel, aluminum oxide, mica and organic polymers. An inner insulating layer 16 of electrically insulating material is applied to an opposite face of the substrate 12. A heating layer 18 of electrically resistive material, such as graphite, tin dioxide, or resistive thick film, is applied to or deposited on a face or exterior surface of the outer layer 14 opposite the substrate 12. The term "resistive material" will encompass any semiconductive or resistive material having a measurable resistance adapted for conversion of electrical energy into substantial heat energy when a current is passed therethrough, as is apparent from the following description. The outer insulating layer 14 can also include a thin (<1 μm) film of silicon dioxide between the ceramic and the heating layer 18 to maintain electrical resistance at high temperatures. Other layers can be added to provide desired thermal, mechanical, chemical, or electrical characteristics. Also, in any of the embodiments, the inner and outer layers 14, 16 can be joined at edges of the substrate to substantially enclose the substrate, as shown in FIG. 6.

The heating panel 10 further includes a plurality of electrically conductive members, such as electrodes 20, attached to the heating layer 18 in electrical communication therewith. The electrodes 20 can be attached directly to the heating layer or mounted on the outer layer 14 with the heating layer deposited thereover. The electrodes 20 are positioned such that the heating layer 18 defines a sheet or film of material extending between the conductors. The electrodes 20 are electrically conductive, elongated bars or braids made of conductive thick film, for example, and provided with connectors, wires, or other means for connecting the electrodes to a source of electrical energy. Preferably, the electrodes are all made of the same material, have the same cross-sectional shape and dimensions, and are the same length.

Figure 2:
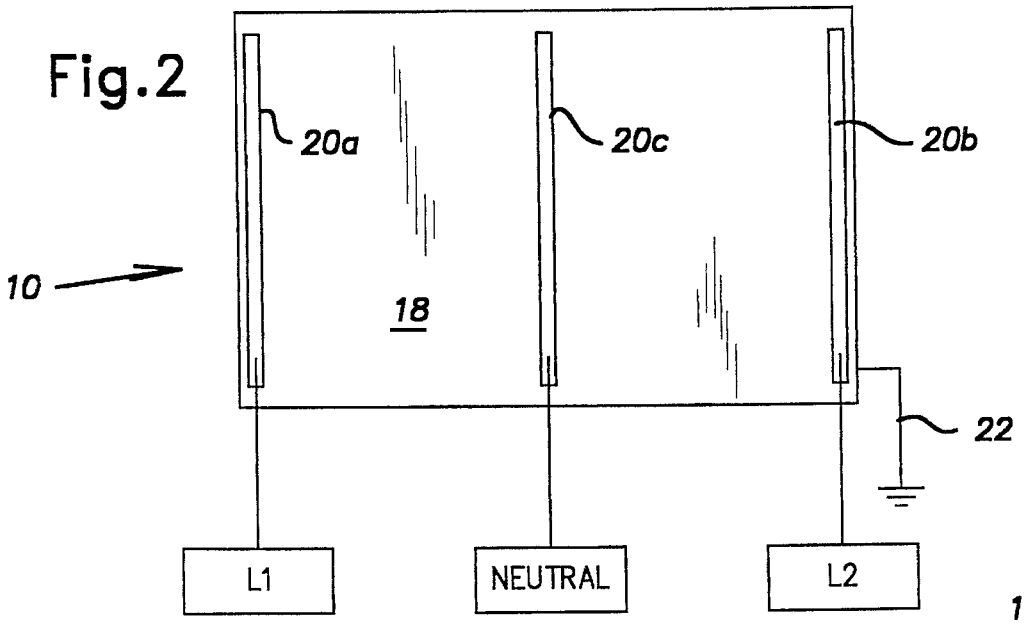
FIG. 2 shows a face of the heating panel of FIG. 1.

Referring to FIGS. 1 and 2, a first electrode 20*a* is attached along one edge of the panel 10 and a second electrode 20*b* is attached along a second, generally parallel, edge of the panel. A third electrode 20*c* is disposed generally parallel with the first and second electrodes 20*a*, 20*b* and about midway therebetween. Preferably, the electrodes 20*a*, 20*b*, 20*c* are precisely evenly spaced. When installed, the first and second electrodes 20*a*, 20*b* are connected to different phases L1, L2 of a two phase power source, such as a synthetic 240 V household power source, sometimes known as the Edison System. Such a power source is a three wire AC system providing 240 volts across two wires, the third wire being a neutral that can also be used as a ground. The third electrode 20*c* is connected to a neutral of the power source. As required by industry standards, the substrate 12 is connected directly to ground by a suitable grounding conductor 22 or indirectly through neutral of the power source. The term "ground" refers generally to any such direct or indirect connections to ground or the neutral.

Current flowing through the heating layer 18 from the power source generates heat, which is conducted through the insulating layers 14, 16 and the substrate 12 to a space or object to be heated. Capacitive currents generated in the substrate 12 by the currents passing through the heating layer 18 cancel each other because the electrodes 20*a*, 20*b* supply current 180° out of phase. Thus, little or no leakage current travels through the ground conductor 22 from the capacitor formed by the heating panel 10.

Figure 3:
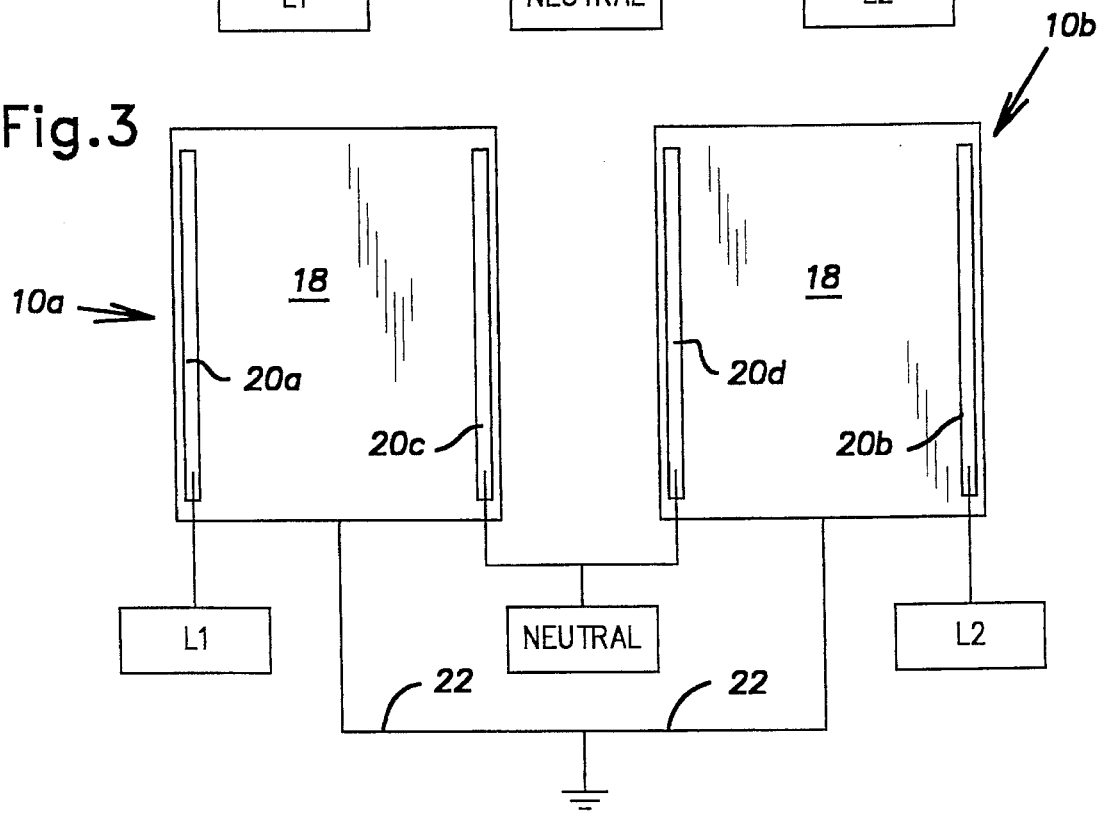
FIG. 3 shows a two heating panel assembly for a two phase system.

Referring to FIG. 3, two heating panels 10*a*, 10*b* are shown. When an even number of heating panels are connected to a two phase power source in the same system or assembly, only two electrodes 20 are required on each panel. The panels 10 are connected in pairs such that the first electrode 20*a* (on the first panel 10*a*) is connected to the first phase L1 and the second electrode 20*b* (on the second panel 10*b*) is connected to the second phase L2. The third electrode 20*c* (on the first panel 10*a*) and a fourth electrode 20*d* (on the second panel 10*b*) are connected to the neutral. The third and fourth electrodes 20*c*, 20*d*, connected to the neutral, are disposed along an edge of the respective panel 10 parallel with and opposite to the corresponding first and second electrodes 20*a*, 20*b*. Substrates of both panels 10*a*, 10*b* are connected to ground through the ground conductor 22.

Figure 4:
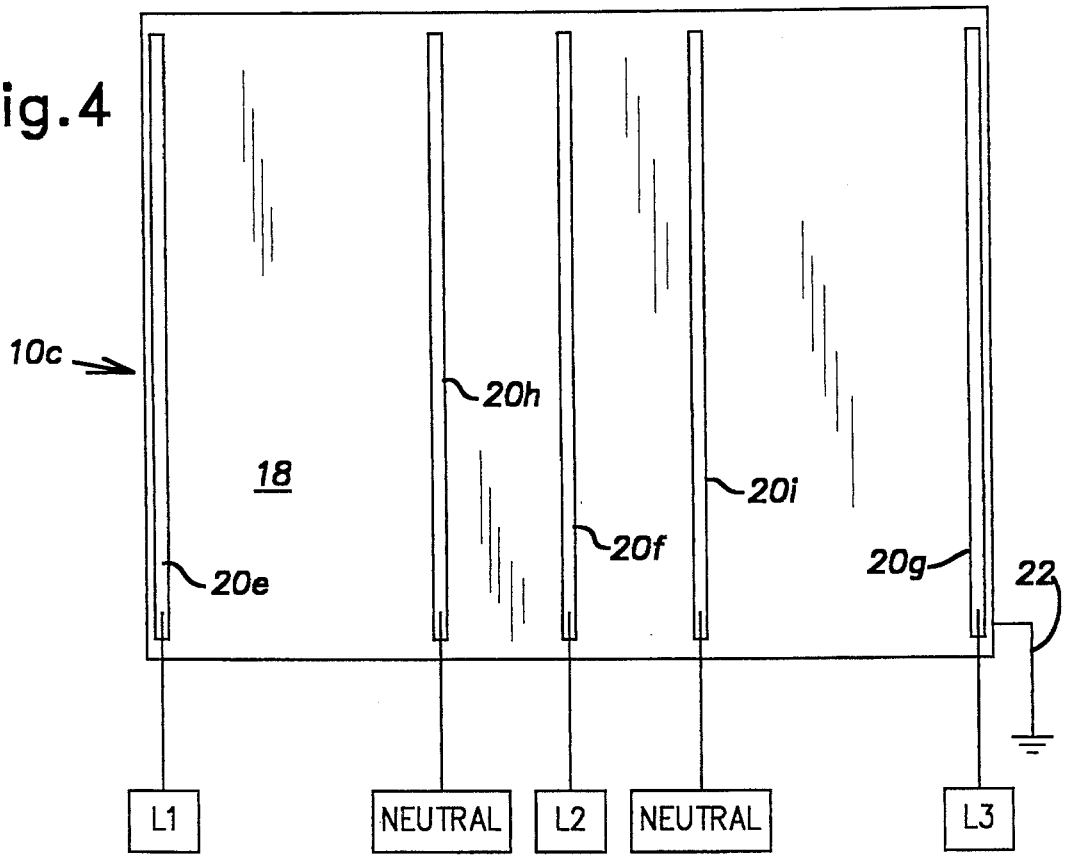
FIG. 4 shows a face of a heating panel for a three phase system.

Referring to FIG. 4, the principles of the present invention also apply where the heating panel 10*c* is connected to a three phase power source. Three electrodes 20*e*, 20*f*, 20*g* are connected to respective phases L1, L2, L3 of the power source. Two of the electrodes 20*e*, 20*g* are disposed along opposite edges of the panel 10*c*, and one of the electrodes 20*f* is disposed near the middle of the panel. Preferably, the electrodes 20*e*, 20*f*, 20*g* are precisely evenly spaced. Two additional electrodes 20*h*, 20*i* are connected to the neutral of the power source and are disposed between pairs of the electrodes 20*e*, 20*f*, 20*g* so as to divide the face of the panel into three substantially equal parts. Theoretically the electrodes should be precisely spaced, as described, but in practice some adjustment may be required depending on the characteristics of the panel. The phases L1, L2, L3 of the power source are displaced 120° with respect to each other. Thus, capacitive leakage currents caused in the substrate by the respective phases cancel each other to minimize leakage current through the ground conductor 22.

Figure 5:
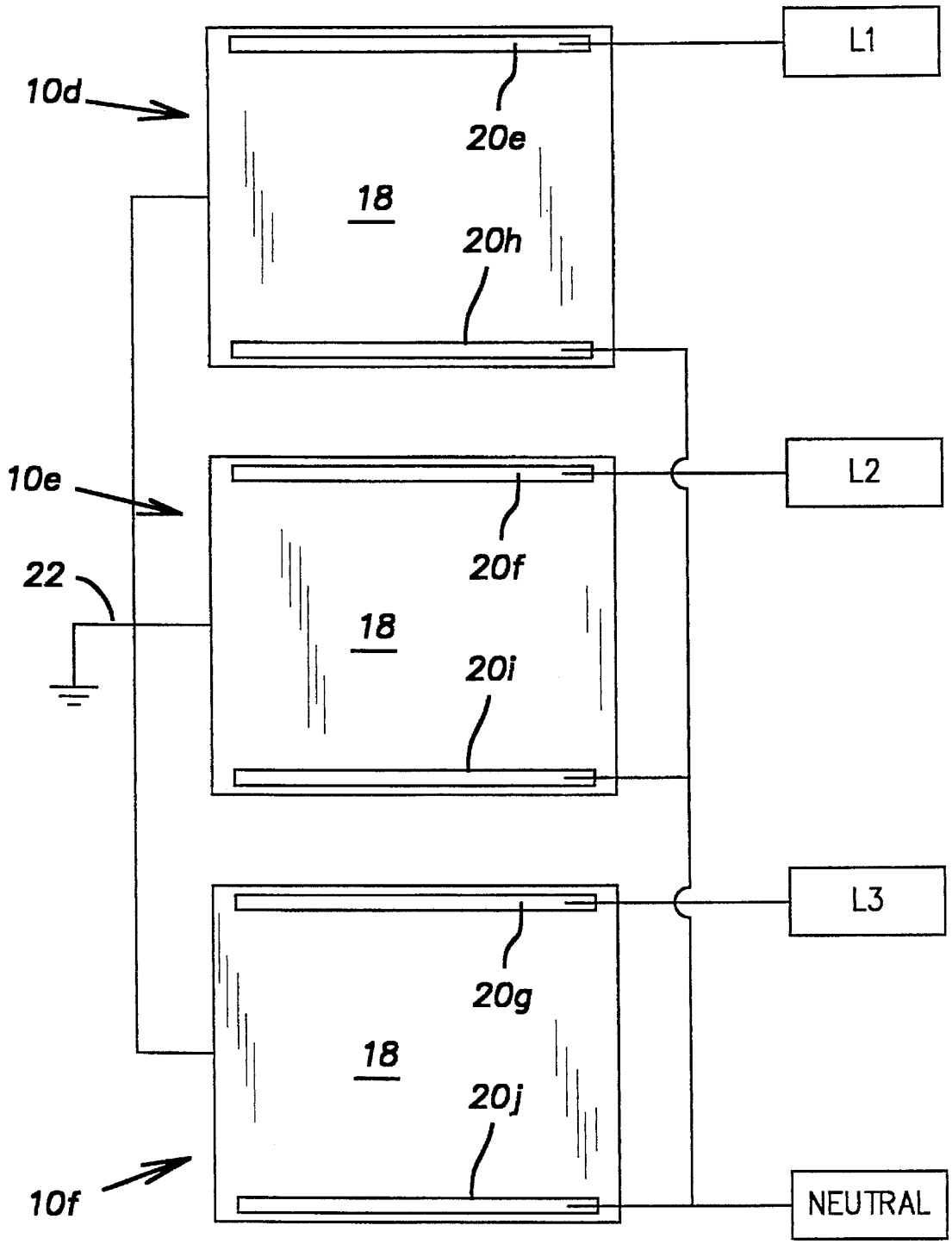
FIG. 5 shows a three heating panel assembly for a three phase system.

Referring to FIG. 5, three heating panels 10*d*, 10*e*, 10*f* are shown. When multiples of three heating panels are connected to a three phase power source in the same system or assembly, only two electrodes 20 are required on each panel. The panels 10 are connected in triads. The first electrode 20*e* (on the first panel 10*d*) is connected to the first phase L1, the second electrode 20*f* (on the second panel 10*e*) is connected to the second phase L2, and the third electrode 20*g* (on the third panel 10*f*) is connected to the third phase L3. Fourth, fifth, and sixth electrodes 20*h*, 20*i*, 20*j*, on respective panels 10*d*, 10*e*, 10*f* are connected to the neutral. The electrodes 20*h*, 20*i*, 20*j* connected to the neutral are disposed along an edge of the respective panel 10*d*, 10*e*, 10*f* parallel with and opposite to the corresponding electrodes 20*e*, 20*f*, 20*g* connected to the three phases L1, L2, L3 of the power source. Substrates of all panels are grounded through the ground conductor 22.

Figure 7:
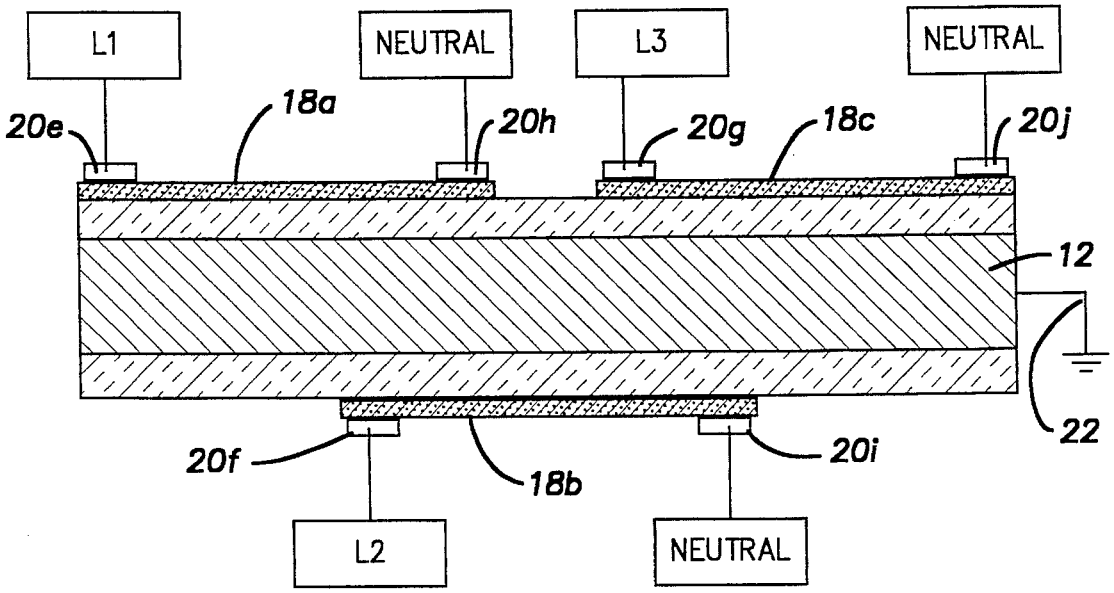
FIG. 7 shows an end view of a heating panel for a three phase system according to another embodiment of the invention.

As shown in FIGS. 6 and 7, plural heating layers can be mounted on single substrate. Referring to FIG. 6, the outer insulating layer 14 and inner insulating layer 16 are disposed on the substrate 12. A first heating layer 18*a* is disposed on the outer insulating layer 14. Two electrodes 20*a*, 20*c* are electrically connected with the heating layer and disposed along opposed edges thereof. One electrode 20*a* is connected to one phase L1 of a two phase power source and the other electrode 20*c* is connected to the neutral. A second heating layer 18*b*, substantially identical with the first, is disposed on the inner insulating layer 16. Two electrodes 20*b*, 20*d* are connected to the second heating layer 18*b* opposite to the electrodes 20*a*, 20*c* on the first heating layer. One electrode 20*b* is connected to the other phase L2 of the two phase power source and the other electrode 20*d* is connected to the neutral. The substrate is connected to ground through the ground conductor 22. This construction is similar to Fig. 3, except that both heating layers are disposed on the same substrate.

Referring to FIG. 7, three heating layers 18*a*, 18*b*, 18*c* are disposed on a single substrate 12. In this case, the heating layers are substantially smaller than the substrate 12. Two of the heating layers 18*a*, 18*c* are disposed on one face of the substrate and the other heating layer 18*b* is disposed on the opposite face. Each heating layer has a first electrode 20*e*, 20*f*, 20*g* connected to a different phase L1, L2, L3 of a three phase power source. A second electrode 20*h*, 20*i*, 20*j* on each heating layer is connected to the neutral of the three phases power source. The substrate is connected to ground through the ground conductor 22. This construction is similar to FIG. 5, except that the heating layers are disposed on the same substrate. Additional layers can be applied over the heating layers 18 for electrical insulation and protection.

Figure 8:
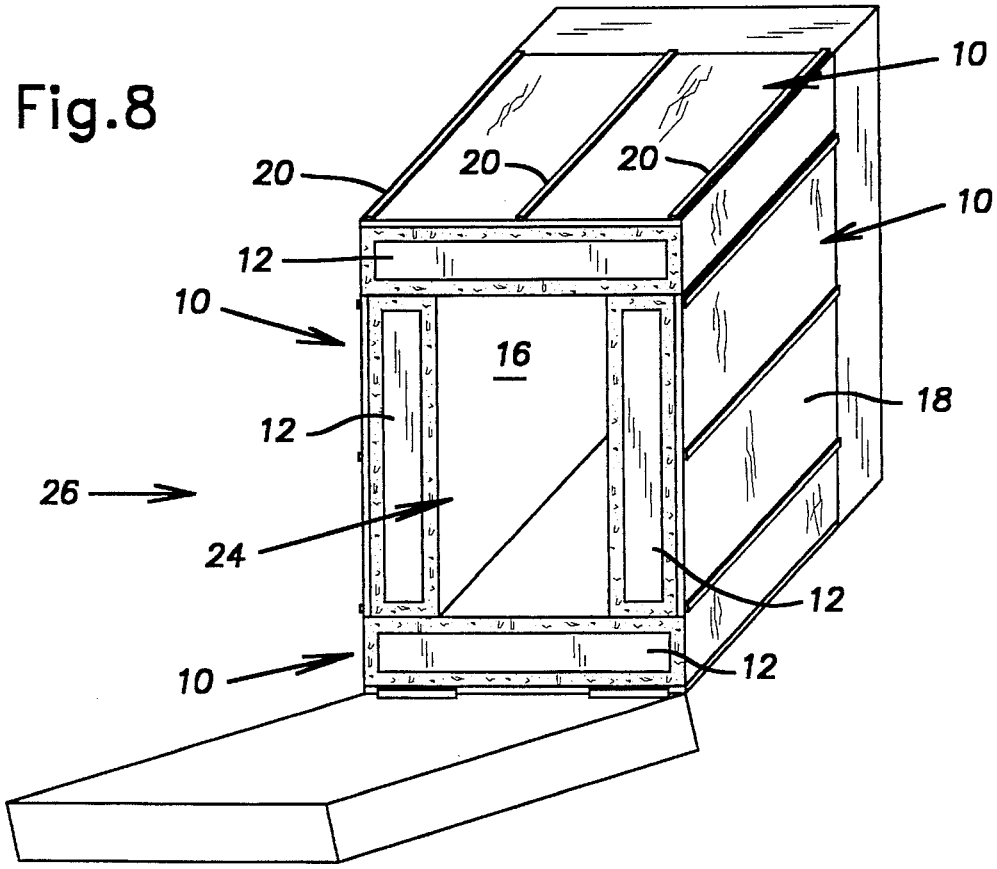
FIG. 8 shows heating panels arranged to form an oven.

Referring to FIG. 8, six heating panels 10 are arranged to form a heating cavity 24 of an oven 26, such as a domestic range used for cooking food. Four heating panels define sides of the generally parallelepipedic heating cavity, one heating panel defines the back wall, and one is pivotally mounted to define a door of the oven 26. The inner insulating layers 16 of the heating panels face inwardly toward the heating cavity 24. FIG. 8 is not to scale and the heating panels 10 are substantially thinner than they appear. The heating panels 10 can be mounted on an existing oven structure or integrally manufactured with the oven structure. The panels 10 shown have three electrodes so that each panel can be separately connected to a multiphase power source. However, since the number of panels is divisible by two and three, the panels can be provided with only two electrodes 20. With two electrodes the panels can be connected in a two phase or three phase system, as described above with reference to FIGS. 3 and 5.

In all of the disclosed embodiments, geometrical and electrical symmetry is preferred. For example, the heating layers 18 should have the same thickness and surface area, as well as the same resistance, between the electrodes to create substantially equal and opposite capacitive currents.

The present disclosure describes several embodiments of the invention, however, the invention is not limited to these embodiments. Other variations are contemplated to be within the spirit and scope of the invention and appended claims.

What is claimed is:

1. A heating panel comprising:

a heating layer of electrically resistive sheet material;

a substrate of electrically conductive sheet material;

an insulating layer disposed between the heating layer and the substrate;

first and second electrodes attached to the heating layer and adapted for being electrically connected to different phases of a multiphase power source; and a third electrode attached to the heating layer and adapted for being electrically connected to a neutral of the power source.

2. A heating panel according to claim 1 wherein the heating layer is adapted for converting electrical current therethrough to heat energy transferred therefrom.

3. A heating panel according to claim 1 wherein the substrate is connected to ground.

4. A heating panel according to claim 1 wherein the insulating layer includes silicon dioxide.

5. A heating panel according to claim 1 further comprising a second insulating layer disposed on a face of the substrate opposite the first insulating layer.

6. A heating panel according to claim 5 wherein the first and second insulating layers are joined so as to substantially enclose the substrate.

7. A heating panel according to claim 1 wherein the third electrode is disposed between the first and second on a face of the heating layer.

8. A heating panel according to claim 1 wherein the first and second electrodes are disposed along opposite edges of the heating layer.

9. A heating panel according to claim 8 wherein the first and second electrodes comprise elongated bars.

10. A heating panel according to claim 9 wherein the third electrode comprises an elongated bar, said electrodes having substantially identical lengths.

11. A heating panel according to claim 1 wherein the heating layer is tin dioxide.

12. A heating panel according to claim 1 wherein the substrate is steel.

13. A heating panel according to claim 1 wherein the insulating layer is porcelain enamel.

14. A heating panel according to claim 1 wherein the power source has two phases and the first and second electrodes are adapted for being connected 180° out of phase.

15. A heating panel according to claim 1 further comprising a fourth electrode electrically connected to the heating layer and adapted for being connected to a third phase of the power source.

16. A heating panel according to claim 15 wherein the power source has three phases and the first, second, and fourth electrodes are adapted for being connected 120° out of phase from each other.

17. A heating panel according to claim 15 further comprising a fifth electrode electrically connected to the heating layer and adapted for being connected to the neutral.

18. A heating panel according to claim 17 wherein the third electrode is disposed between the first and second electrodes and the fifth electrode is disposed between the second and fourth electrodes.

19. A heating panel according to claim 18 wherein the first and fourth electrodes are disposed along opposite edges of the heating layer and the second electrode is disposed about midway between the first and fourth electrodes.

20. A heating panel assembly comprising:

first and second heating panels, each panel comprising a heating layer of electrically resistive sheet material electrically connected to ground; a substrate of electrically conductive sheet material; an insulating layer disposed between the heating layer and the substrate; and first and second electrodes attached to the heating layer;

the first electrodes being respectively electrically connected to different phases of a multiphase power source; and the second electrodes being electrically connected to a neutral of the power source.

21. A heating panel assembly according to claim 20 wherein the heating panels are arranged to define a heating cavity.

22. A heating panel assembly according to claim 20 further comprising:

a third heating panel comprising a heating layer of electrically resistive sheet material; a substrate of electrically conductive sheet material electrically connected to ground; an insulating layer disposed between the heating layer and the substrate; and first and second electrodes attached to the heating layer;

the first electrode of the third panel being adapted for being electrically connected to a phase of the multiphase power source different from the phases to which the first electrodes of the first and second panels are adapted for being connected; and the second electrode of the third panel being adapted for being electrically connected to the neutral of the power source.

23. A heating panel assembly according to claim 22 wherein the heating panels are arranged to define a heating cavity.

24. A heating panel comprising:

a heating layer of electrically resistive sheet material;

a substrate of electrically conductive sheet material adapted for being connected to ground;

an insulating layer disposed between the heating layer and the substrate;

a second insulating layer disposed on a face of the substrate opposite the first insulating layer;

first and second electrodes attached to the heating layer along opposite edges of the heating layer and adapted for being electrically connected to different phases of a multiphase power source; and a third electrode attached to the heating layer between the first and second electrodes and adapted for being electrically connected to a neutral of the power source.

25. A heating panel comprising:

a substrate of electrically conductive sheet material;

first and second heating layers of electrically resistive sheet material disposed on opposite faces of the substrate;

a first insulating layer disposed between the first heating layer and the substrate;

a second insulating layer disposed between the second heating layer and the substrate;

first and second electrodes attached to each heating layer;

the first electrodes on each heating layer being respectively adapted for being electrically connected to different phases of a multiphase power source; and the second electrodes on each heating layer being adapted for being electrically connected to a neutral of the power source.

26. A heating panel according to claim 25 wherein the substrate of the panel is adapted for being electrically connected to ground.

27. A heating panel according to claim 25 further comprising:

a third heating layer of electrically resistive sheet material disposed adjacent the first heating layer on a face of the substrate, the first insulating layer being disposed between the third heating layer and the substrate; and first and second electrodes attached to the third heating layer;

the first electrode of the third heating layer being adapted for being electrically connected to a phase of the multiphase power source different from the phases to which the first electrodes of the first and second heating layers are adapted for being connected; and the second electrode of the third heating layer being adapted for being electrically connected to the neutral of the power source.

28. A heating panel assembly according to claim 27 wherein the substrate is adapted for being electrically connected to ground.

29. An oven comprising:

an enclosure defining a generally parallelepipedic cooking cavity having five walls closed by a door;

a heating panel disposed on each of the five walls and the door, each heating panel comprising:

a heating layer of electrically resistive sheet material;

a substrate of electrically conductive sheet material;

an electrically insulating material substantially enclosing the substrate to define inner and outer insulating layers, said outer insulating layer being disposed between the heating layer and the substrate and said inner insulating layer facing the cavity;

a first electrode attached along an edge of the heating layer and adapted for being electrically connected to one phase of a multiphase power source;

a second electrode attached along an edge of the heating layer opposite from the first electrode and adapted for being electrically connected to a second phase of the multiphase power source; and a third electrode attached to the heating layer between the first and second electrodes and adapted for being electrically connected to a neutral of the multiphase power source.

30. An oven having an oven cavity heated by conversion of electrical energy into heat energy comprising:

an insulating layer fabricated of an electrically insulative material and with a geometric shape enclosing said oven cavity to be heated, said insulating layer having a first surface forming an exterior surface of said cavity and a second surface forming an interior surface of said cavity and from which heat energy enters said cavity after conduction through said insulating layer;

a substrate fabricated of an electrically conductive material electrically connected to ground and secured to said insulating layer first surface and from which heat energy enters said cavity after conduction through said substrate;

a plurality of spaced-apart electrically conductive members positioned adjacent to said insulating layer first surface;

a sheet of material directly secured between, and in electrical contact with, said plurality of conductive members and secured to at least a portion of said insulating layer first surface;

at least one additional plurality of spaced-apart electrically conductive members positioned adjacent to said insulating layer first surface at a location remote from said plurality of conductive members;

at least one additional sheet of material, secured to other portions of said insulating layer first surface different from the portion of said insulating layer first surface to which said sheet of material is secured, each of said at least one additional sheet directly secured and electrically connected between at least an associated pair of the at least one additional plurality of conductive members;

the material of said sheet and said at least one additional sheet having a predetermined electrical resistance measurable between different ones of said conductive and additional conductive members;

the resistance of said material of said sheet and of said at least one additional sheet of material causing conversion of electrical energy, coupled into said sheet and said at least one additional sheet via associated ones of the total number of said conductive members, into heat energy for energy transfer through said insulating layer and from said insulating layer second surface into said cavity; and means for connecting a source of multiphase electrical energy to predetermined ones of the total number of conductive members to cause electrical energy to be converted to heat energy in associated predetermined ones of the sheet and the at least one additional sheet fabricated upon said insulating layer first surface, wherein two of said conductive members are adapted for being connected to different phases of the multiphase source and a third one of said conductive members is adapted for being connected to a neutral of the multiphase source.

31. An oven according to claim 30 wherein the conductive members are arranged so as to cause opposed capacitive currents.

32. An oven according to claim 30 wherein two of said additional conductive members are adapted for being connected to different phases of the multiphase source and a third one of said additional conductive members is adapted for being connected to the neutral of the multiphase source.

* * * * *

UNITED STATES PATENT AND TRADEMARK OFFICE

CERTIFICATE OF CORRECTION

PATENT NO. : 5,577,158

DATED : November 19, 1996

INVENTOR(S) : Kallgren et al.

It is certified that error appears in the above-identified patent and that said Letters Patent is hereby corrected as shown below:

Claim 20, line 4, delete "electrically conected to ground".

Claim 20, line 5, after "material" insert --electrically connected to ground--.

Signed and Sealed this

Twenty-second Day of December, 1998

*Attest:*

*Attesting Officer*

BRUCE LEHMAN

*Commissioner of Patents and Trademarks*